United States Patent [19]

Galardo

[11] Patent Number: 4,848,839

[45] Date of Patent: Jul. 18, 1989

[54] KNOCKDOWN SOFA

[76] Inventor: Richard A. Galardo, 665 N. Baldwin Park Blvd., City of Industry, Calif. 91746

[21] Appl. No.: 146,887

[22] Filed: Jan. 22, 1988

[51] Int. Cl.[4] ..... A47C 7/00

[52] U.S. Cl. ..... 297/440; 297/194; 297/443; 403/407.1

[58] Field of Search ..... 297/194, 440, 442, 443, 297/444; 403/405.1, 403, 407.1, 231, 406.1

[56] References Cited

U.S. PATENT DOCUMENTS

| | | | |
|---|---|---|---|
| 607,905 | 7/1898 | Wyngaard | 297/194 X |
| 2,605,820 | 8/1952 | Powellek | 403/407.1 X |
| 2,703,600 | 3/1955 | Harper | 297/194 X |
| 3,759,571 | 9/1973 | Korch | 297/440 X |
| 3,799,611 | 3/1974 | Steinfeld | 297/440 |
| 3,870,366 | 3/1975 | Rogers | 297/440 |
| 3,929,375 | 12/1975 | Gans | 297/440 |
| 4,077,517 | 3/1978 | Hilemn | 297/440 X |
| 4,140,065 | 2/1979 | Chacon | 297/440 X |
| 4,209,198 | 6/1980 | Apple, Sr. | 297/443 |
| 4,502,810 | 3/1985 | Nock | 403/407.1 X |

FOREIGN PATENT DOCUMENTS

| | | | |
|---|---|---|---|
| 653297 | 2/1963 | Italy | 297/440 |

*Primary Examiner*—Kenneth J. Dorner
*Assistant Examiner*—Thomas A. Rendos
*Attorney, Agent, or Firm*—Nilsson, Robbins, Dalgarn, Berliner, Carson & Wurst

[57] ABSTRACT

An article of seating furniture of the upholstered type that can be readily assembled and disassembled. Back and front panel members are attached to two spaced apart inner side-support panel members and two spaced apart outer side-support panel members; a seat member is mounted between the front and back panel members and the inner side-support panel members; and a back support member is mounted above the seat member and against the back panel member. Cushions and coverings, attached to the outer side-support and back panel members, are draped over the sides of the furniture to provide and aesthetically pleasing appearance associated with full-size furniture.

15 Claims, 3 Drawing Sheets

FIG. 1
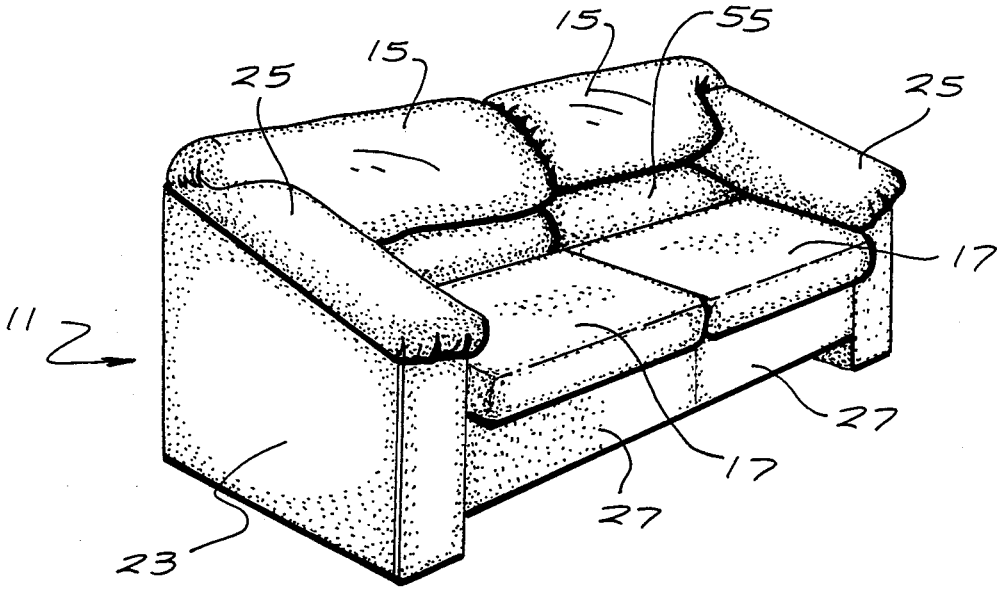
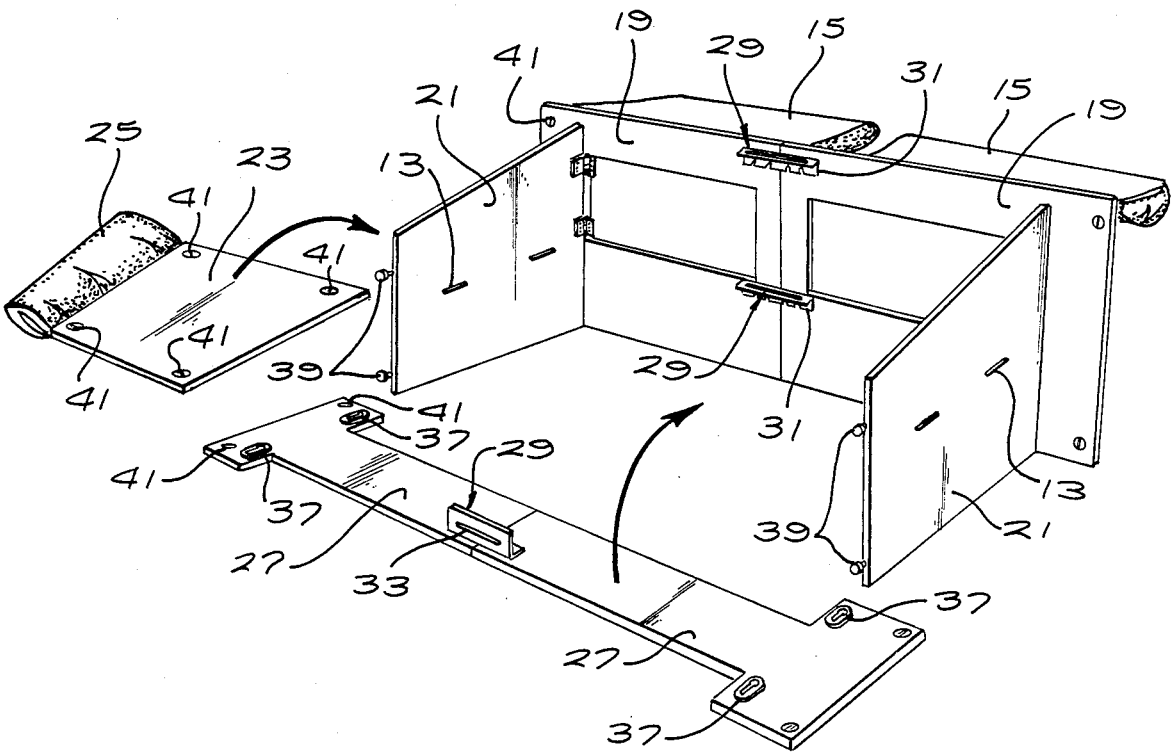
FIG. 2

FIG. 9
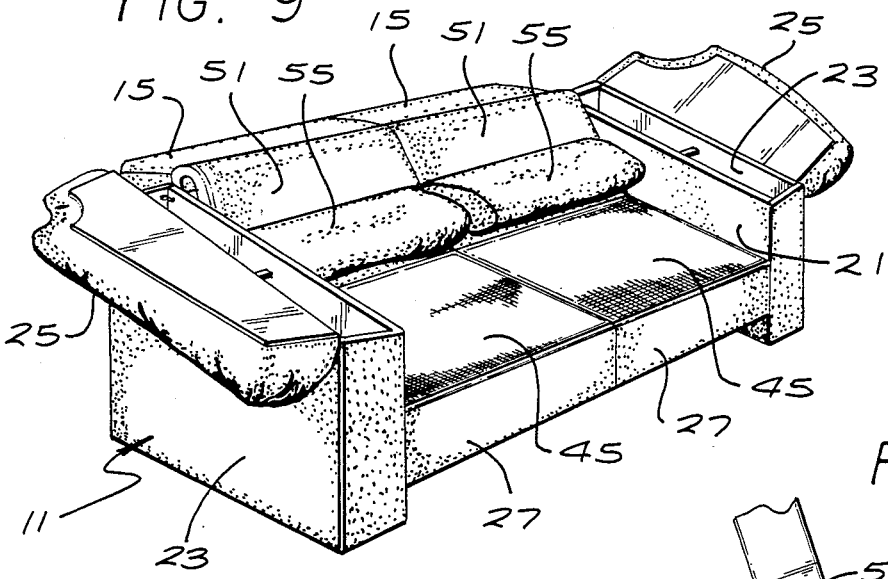
FIG. 5
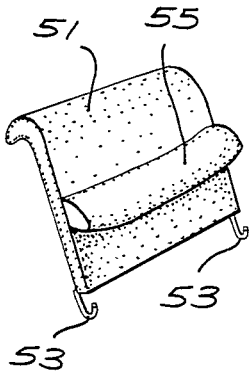
FIG. 6
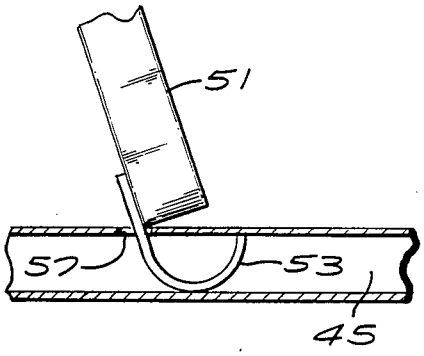
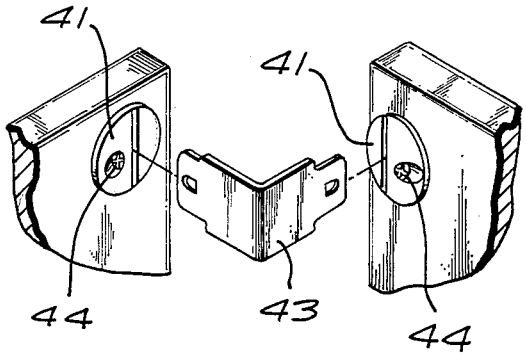
FIG. 8
FIG. 7
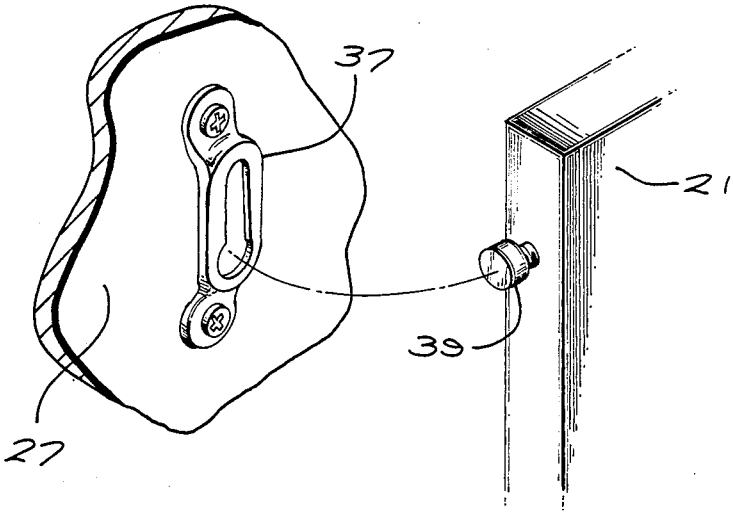

KNOCKDOWN SOFA

FIELD OF THE INVENTION

This invention pertains to knockdown seating furniture of the upholstered type that can be readily assembled and disassembled.

BACKGROUND OF THE INVENTION

There is a continued and great demand for knockdown furniture. Knockdown furniture is of the type which can be easily disassembled into a variety of pieces and readily reassembled. An important advantage to knockdown furniture is a reduction in the volume of space necessary for transporting and storing the article of furniture. Ideally, such furniture, when disassembled, can be placed in cartons which (1) are sufficiently small to permit transport in conventional automobiles, (2) can be handled by one person during transport, and (3) can be stored in a minimum amount of space. Significant labor savings are typically also achieved in construction of knockdown furniture, since the component pieces may be manufactured utilizing assembly-line techniques and no assembly costs are incurred by the manufacturer. Finally, replacement or repair of component parts, as well as partial or full reupholstering of the furniture, is more readily achieved.

The above advantages being clear, there still remain certain disadvantages and problems that need to be overcome with respect to the current state of the industry for knockdown furniture. These problems include the inherent instability arising from numerous individual pieces being detachably assembled together. The connectors commonly used to assemble knockdown furniture have often been inadequate causing the user an inordinate amount of movement and vibration during normal use. Furniture designers have used elaborate connecting devices, close tolerances, lug-type connectors, and various brackets in their attempt to overcome this disadvantage. Often these devices require the use of a variety of tools, mechanical skills and knowledge to utilize the tools and devices, as well as assistance in holding and moving the furniture pieces from at least one other individual during assembly.

Another disadvantage to knockdown furniture concerns aesthetics. Heretofore, knockdown furniture was readily recognizable, typically having a thin frame construction which further implied flimsiness for the product.

It is a feature of the present invention to provide a knockdown sofa that can be easily assembled and disassembled to facilitate transport and storage, as well as repair and replacement of parts.

It is another feature of the present invention to provide a knockdown sofa that is easy to upholster and reupholster, either partially or totally.

It is still another feature of the present invention to provide a knockdown sofa that is as aesthetically appealing as standard furniture, but which can be produced at a lower cost, and has the advantages of easy assembly, disassembly, storage and transport.

It is yet another feature of the present invention to provide a knockdown sofa that is sturdy when assembled and remains sturdy during use.

It is yet another feature of the present invention to provide a knockdown sofa that can be assembled, disassembled, packed, and carted by a single individual without need for a large variety of tools and devices and the mechanical skills and knowledge to use such tools and devices.

SUMMARY OF THE INVENTION

The present invention relates to an article of furniture of the upholstered type that can be easily assembled and disassembled. In particular, the article of furniture is a knockdown sofa consisting of four side-support panel members, two back panel members, two front panel members, two seat members, and two back support members. Cushions are inherently part of the seat members or separate members as desired. Cushion coverings are attached to two of the side-support panels and cover the side "arms" formed by the panel members. Similar cushions are attached to the back panel members and are folded over the back support member providing a soft lounge or cushioned sofa appearance. The "arms" of the sofa are formed by attaching two of the side-support panel members to a back panel member and a front panel member. The side-support panel members are parallel to each other, but spaced apart at a desired distance. A second set of side-support panel members and back and front panel members are assembled to form a mirror image of the first assemblage. These two units are then placed linear to each other with the arms parallel to each other at the outermost position. The assemblages are then united, preferably by use of a bracket or device that can be used to draw the back panels to each other and the front panels to each other, forming the base structure. Seat members are affixed in the space created by the inner side-support panel members and the back and front panel members. A detachable cushion covers the "arm," a rectangular compartment made on each side by the two side-support panel members and the front and back panel members. A back-support member may be affixed to the sofa, preferably to the seat member and leaned against the back panel member providing for an inclined back rest. Additional cushioning is provided by a detachable cushion which is affixed to the rear side of the back panel and folds over the back panels onto and over the back support member.

The areas of the assembled sofa that are visible are upholstered to provide a finished product that is sturdy, readily assembled and disassembled, can be easily replaced, repaired and reupholstered, and is aesthetically pleasing.

BRIEF DESCRIPTION OF THE DRAWINGS

So that the manner in which the above-recited features, advantages, and objects of the invention, as well as others which will become apparent, are attained and can be understood in detail, a more particular description of the invention briefly summarized above may be had by reference to the embodiments thereof, illustrated in the appended drawings, which form a part of this specification.

IN THE DRAWINGS

FIG. 1 is a perspective view of an assembled knockdown sofa made in accordance with the present invention.

FIG. 2 is a perspective view of a partially assembled knockdown sofa illustrating the various members used therein.

Figure 3:
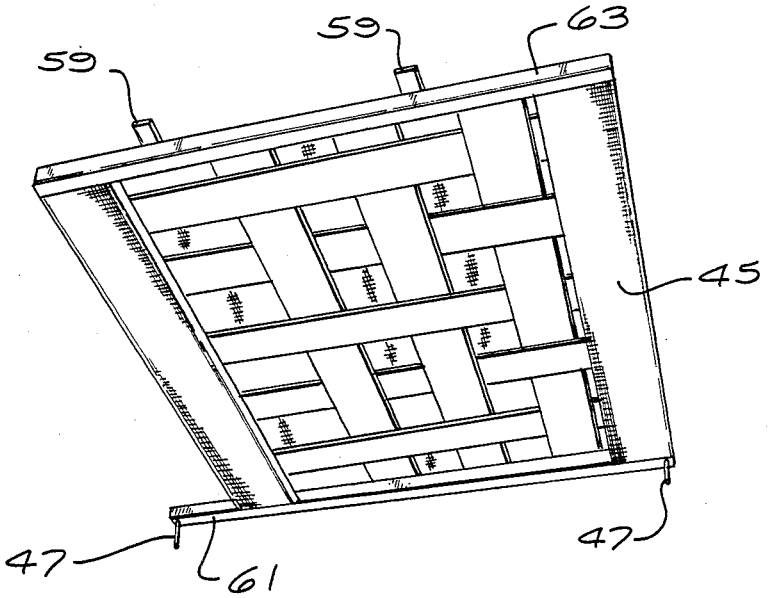

FIG. 3 is a perspective view of a seat member including positioning guides attached thereto.

Figure 4:
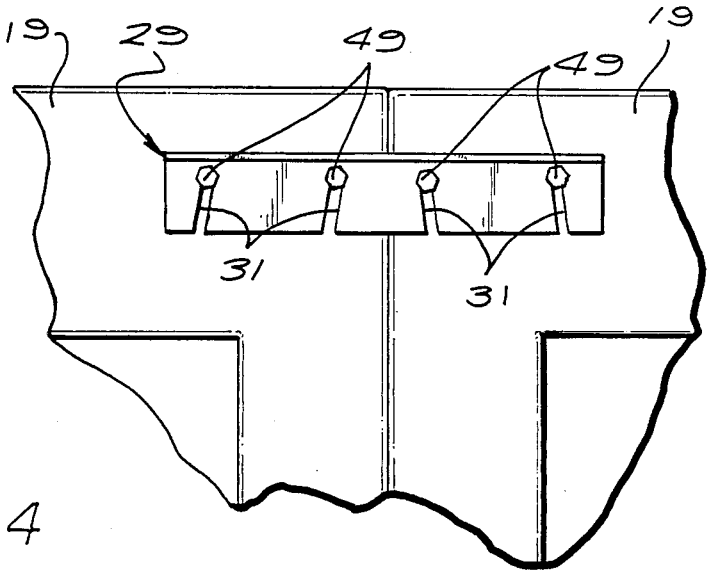

FIG. 4 illustrates a bracket useful in the present invention, which bracket linearly mates the back panel members together, the front panel members together, and serves to support, in part, the seat member.

FIG. 5 is a perspective view of a back-support member including a positioning hook attached to the bottom.

FIG. 6 is an enlarged cross-sectional view of portions of the seat member and of the back-support member, including the positioning hook, illustrating attachment of the positioning hook of the back-support member in the seat member.

FIG. 7 is a perspective view of a connecting device used to attach the side-support panel members to the rear and front panel members.

FIG. 8 is an exploded view illustrating an alternate connecting device useful in attaching the side-support panel members to the front and back panel members.

FIG. 9 illustrates a partially assembled knockdown sofa in accordance with the present invention.

DESCRIPTION OF THE PREFERRED EMBODIMENTS

Now referring to the drawings, and first to FIG. 1, a fully assembled knockdown sofa in accordance with the present invention is illustrated. Seat cushion 17, armrest cushion covering 25, and back rest cushion 15 are detachable. The sofa 11 is fully upholstered from all viewing points.

FIG. 2 illustrates the partially assembled sofa of FIG. 1. A first back panel member 19 is attached to an inner side-support panel member 21. The method of attachment can vary depending on the degree of sturdiness desired and complexity of assembly that is acceptable. Two preferred methods of attaching the panels are discussed later in connection with FIGS. 7 and 8. A second inner side-support panel member 21 is similarly attached to a second back panel member 19. This second assemblage, a mirror image of the first assemblage, is connected with the first assemblage by means of two horizontally elongated L-shaped slotted brackets 29. Two outer side-support panel members 23 are connected to the back panel members 19. The outer side-support panel members 23 each include a detachable armrest cushion covering 25 attached to the outermost side of the outer side-support panel member 23 and which is folded over the opening between the outer side-support panel member 23 and the inner side-support panel member 21. The inside surface of cushion 25, i.e., that which is proximate to side-support panel members 23 and 21 when in a covered or closed position, is preferably made of a sturdy substance to prevent collapse of the cushion into the space between side-support panel members 23 and 21. Although various methods of attaching the armrest cushion covering 25 to outer side-support panel member 23 may be used, a preferred method is VELCRO filamentary hook and loop strips.

The two front panel members 27 are attached together with a third horizontally elongated L-shaped bracket 29. Optionally, if the front panel members 27 are raised in part above floor level, as illustrated in FIG. 2, it is preferred to place a support bracket (not shown) at the bottom abutting edges of the front panel members to prevent user stress from causing the front panel members to separate at that point. Front panel members 27 are attached to side panel members 21 and 23 to complete the basic frame of the sofa.

FIG. 3 depicts a seat member 45 for use in the present invention. The side edges of seat member 45 preferably include two hollow metal side support members 61 and 63. Side support member 61 further includes two positioning guides 47 and side support member 63 includes at least one and preferably two flange members 59 protruding outwardly therefrom and parallel with the plane of seat member 45. The rest of seat member 45 is made conventionally such as by using wood side supports with a elastic webbing therebetween.

FIG. 4 illustrates how horizontally elongated L-shaped bracket 29 is used to attach the back panel members 19 together and the front panel members 27 together. The bracket is right-angled or L-shaped, and also preferably serves, in part, as the support for seat member 45. Bracket 29 is used in connection with coupling bolts 49, which bolts are predeterminately fastened to front panel members 27 and back panel members 19. Bracket 29 has at least two and preferably four channels 31 on one side for receiving coupling bolts 49. These channels 31 slant outwardly such that when bracket 29 is placed between the two panel members to be attached and the heads of coupling bolts 49, with the bolts being placed in the channels 31, the panel members will be drawn together when pressure is applied to bracket 29 and the coupling bolts approach the top of the channels 31. The result is a simple, sturdy positive linear attachment of the two back panel members and the two front panel members that can be accomplished by a single individual. At least two brackets should be used in connection with the back panel members 19 due to the height of the back panel members. However, one bracket should be adequate for use in connection with the front panel members 27.

Two of the brackets 29 also serve the second purpose of providing support for seat member 45. These two brackets 29, which are positioned at the desired seat height, one each on back and front panel members, also each include a slot 33 (see, FIG. 2) for receiving the positioning guides 47 of seat member 45. Thus, by hooking the two brackets 29 together by means of the hollow metal side support member 61 and positioning guides 47 strong internal support against inward pressure and outward expansion of the front and back panel members as well as twisting movement is prevented. Additional side supports are required to retain seat member 45 in the horizontal position. Such supports can be in the form of brackets (not shown) located on the inner side-support panel members, front panel members, or back panel members. Another form of support, illustrated in FIG. 3, includes one or more flange members 59 extending outwardly from seat member 45 which mate with slotted openings 13 predeterminately located on inner side-support panel members 21.

Now turning to FIG. 5, a back support member 51 is illustrated. Back support member 51 is similar in width to seat member 45 and preferably has a detachable cushion member 55 traversing the width of member 57 to essentially cover the lower area of the back support member 51. The very top portion of back support member 51 curves outwardly away from the area of cushion member 55. The back support member 51 may be simply leaned against the back panel member 19. Optionally, the bottom of back support member 51 includes downwardly projecting, upwardly curving hooks oppositely located on the sides of back support member 51.

FIG. 6 illustrates how hooks 53 are useful in connection with the attaching of back support member 51 to seat member 45. Each of the hollow metal side supports 61 and 63 has a predeterminately placed aperture 57 in the upward facing section capable of receiving hooks 53 of back panel member 51. These apertures 57 are placed a distance spaced apart from the back panel members such that when back support member 51 is attached thereto via hooks 53, the hooks 53 will enter and lock in hollow metal side support member 61, allowing the back support member to be leaned against back panel members 19. Once placed in a backwardly leaning position, back support member 51 will remain in that position due to gravitational forces. Hooks 53 serve to retain the back support member 51 in a specific position and prevent same from moving upward or forward during use of the sofa.

In FIGS. 7 and 8, two preferable means for attaching side panels 21 and 23 to front panel members 27 and back panel members 19 are illustrated. FIG. 7 is an enlarged view of an attaching device (also shown in FIG. 2) showing coupling bolt 39 attached to one edge of side-support panel member 21 and a receiving bracket 37 attached to an inside face of front panel member 27. Receiving bracket 37 is attached to front panel member 27 by means of screws, with its center section extending outwardly with a slot therein for receiving coupling bolt 39. The slot is enlarged at one end to permit passage of the head of coupling bolt 39 and narrows thereafter in size to a degree slightly larger than the neck of coupling bolt 39. Receiving bracket 37 is affixed in a vertical fashion on front panel member 27 with the largest portion of the opening placed in the downward position. Thus, to attach the front panel member 27 onto the inner side-support panel member 21, one would raise front panel member 27 to a slightly higher position than inner side-support panel member 21, align the head of coupling bolt 39 with the enlarged portion of the slot in receiving bracket 37, push the panels together to permit the head of coupling bolt 39 to pass through the enlarged portion of the slot in receiving bracket 37 and push front panel member 27 downward to lock the panels together.

An alternate means of attaching the panels together is illustrated in the exploded illustration of FIG. 8, as well as generally in FIG. 2. Here an L-shaped connector is used to lock two panel members together, in this case front panel member 27 and outer side-support panel member 23. The L-shaped connector includes two apertures therein for mating with plastic or metal receivers 41 which are predeterminately affixed in the panels. The receivers contain screws 44 which are angularly driven through the aperture found in the flange portion of connector 43, thereby locking the panels together.

FIG. 9 illustrates the partially assembled sofa 11 with seat members 45 in place. Arms 25 are open revealing a compartment area formed by the outer and inner side-support panel members and front and rear panel members at the area of the armrest. This space may be used for storing any number of items thus providing for a more efficient use of space than found with prior sofas.

The use of four side panels produces an unusually sturdy design, and provides a sofa that, when upholstered, has an aesthetic look previously unavailable in knockdown furniture. For example, in one embodiment of the present invention, all of parts of an approximately 81" long sofa, including cushion members, will fit into a single standard size warehouse carton being $33\frac{1}{2}'' \times 28'' \times 41''$ in dimension. The use of panels permits each panel member to be separately upholstered, greatly reducing the time and effort necessary to upholster the piece of furniture in total.

While particular embodiments of the invention have been described, it will be understood that the invention is not limited thereto, since modifications may be made and will become apparent to those skilled in the art.

What is claimed is:

1. An article of furniture of the upholstered type that can be assembled and disassembled, comprising:
   - two laterally spaced outer side-support panel members;
   - two inner side-support panel members laterally spaced from and parallel to the two outer side-support panel members;
   - back panel means capable of attaching to the outer side-support panel members and to the inner side-support panel members;
   - front panel means parallel to the back panel means;
   - means for attaching the front panel means to the outer side-support panel members and means for attaching the front panel means to the inner side-support panel members so as to form, when attached together, a large inner rectangluar compartment and two smaller outer rectangular compartments;
   - a seat member;
   - means for mounting the seat member horizontally in the large inner rectangular compartment;
   - back support means mountable above the seat member and against the back panel means; and
   - covering means attachable to either the outer side-support panel members or the inner side-support panel members for covering the top opening formed by each of the small rectangular compartments.

2. An article of furniture in accordance with claim 1, wherein the back panel means comprises two back panel members linearly attached to each other.

3. An article of furniture in accordance with claim 1, wherein the front panel means comprises two front panel members linearly attached to each other.

4. An article of furniture in accordance with claim 1, wherein the covering means comprises two cushion-like coverings each with a rigid backing on one side of a size sufficiently large to rest on the top of the small rectangular compartment, wherein the coverings are attached to the outer side-support panel members and are drapable over each small rectangular compartment to provide a full-upholstered armrest appearance.

5. An article of furniture of the upholstered type that can be assembled and disassembled, comprising:
   - two laterally spaced outer side-support panel members;
   - two inner side-support panel members laterally spaced from and parallel to the two outer side-support panel members;
   - back panel means capable of attaching to the outer side-support panel members and to the inner side-support panel members, comprising two back panel members linearly attached to each other by a coupling means comprised of a plurality of coupling bolts attached to the back panel members and by at least two horizontally elongated L-shaped brackets having a plurality of channels for receiving the heads of the coupling bolts, said channels extending downward and outward from the center of the L-shaped angle in a manner such that when the heads of the coupling bolts are mated with the channels and pressure is applied downwardly on the brackets the back panel members will be pulled together thereby forming a contiguous back panel;

front panel means parallel to the back panel means and capable of attaching to the outer side-support panel members and the inner side-support panel members so as to form, when attached together, a large inner rectangular compartment and two smaller outer rectangular compartments;

a seat member;

means for mounting the seat member horizontally in the large inner rectangular compartment;

back support means mountable above the seat member and against the back panel means; and covering means attachable to either the outer side-support panel members or the inner side-support panel members for covering the top opening formed by each of the small rectangular compartments.

6. An article of furniture of the upholstered type that can be assembled and disassembled, comprising:

two laterally spaced outer side-support panel members;

two inner side-support panel members laterally spaced from and parallel to the two outer side-support panel members;

back panel means capable of attaching to the outer side-support panel members and to the inner side-support panel members;

front panel means parallel to the back panel means and capable of attaching to the outer side-support panel members and the inner side-support panel members so as to form, when attached together, a large inner rectangular compartment and two smaller outer rectangular compartments, and front panel means comprising two front panel members linearly attached to each other by a coupling means comprised of a plurality of coupling bolts attached to the front panel members and at least one elongated L-shaped bracket having a plurality of channels for receiving the heads of the coupling bolts, said channels extending downward and outward from the center in a mannner such that when the heads of the coupling bolts are mated with the channels and pressure is applied downwardly on the bracket, the front panel members will be pulled together thereby forming a contiguous front panel;

a seat member;

means for mounting the seat member horizontally in the large inner rectangular compartment;

back support means mountable above the seat member and against the back panel means; and covering means attachable to either the outer side-support panel members or the inner side-support panel members for covering the top opening formed by each of the small rectangular compartments.

7. An article of furniture of the upholstered type that can be assembled and disassembled, comprising:

two laterally spaced outer side-support panel members;

two inner side-support panel members laterally spaced from and parallel to the two outer side-support panel members;

back panel means capable of attaching to the outer side-support panel members and to the inner side-support panel members comprising;

front panel means parallel to the back panel means and capable of attaching to the outer side-support panel members and the inner side-support panel members so as to form, when attached together, a large inner rectangular compartment and two smaller outer rectangular comprising;

a seat member;

means for mounting the seat member horizontally in the large inner rectangular compartment;

back support means mountable above the seat member and against the back panel means, comprised of at least one back support member having two downwardly projecting, curved hooks and the seat member includes a pair of interior channels parallel to the side-support panel members, each channel having an aperture therein for receiving and retaining a respective hook, the apertures being positioned sufficient distance from the edge most proximate to the back panel means to permit the back support member to lean against the back panel means; and covering means attachable to either the outer side-support panel members or the inner side-support panel members for covering the top opening formed by each of the small rectangular compartment.

8. An article of furniture of the upholstered type that can be assembled and disassembled, comprising:

two laterally spaced outer side-support panel members;

two inner side-support panel members laterally spaced from and parallel to the two outer side-support panel members;

at least two back panel members linearly attached to each other and eah capable of attaching to one outer side-support panel member and one inner side-support panel member;

at least two front panel members linearly attached to each other, parallel to the back panel members;

means for attaching a respective one of the back panel members to one of the outer side-support panel members and means for attaching a respective one of the back panel members to one of the inner side-support panel members such that the eight panel members, when attached together, form a large inner rectangular compartment and two smaller outer rectangular compartments;

at least two seat members;

means for mounting the two seat members horizontally in the large inner rectangle;

at least two back support members mountable above the seat members and against the back panel members; and two coverings attachable to either the outer side-support panel members or the inner side-support panel members for covering the top opening formed by each of the small rectangles.

9. An article of furniture in accordance with claim 8, wherein the two coverings are cushion-like coverings each with a rigid backing on one side of a size sufficiently large to rest on the top of the small rectangular compartment, are attached to the outer side-support panel members, and are drapable over the small rectangular compartment to provide a full-upholstered armrest appearance.

10. An article of furniture in accordance with claim 8, further comprising at least one back panel covering dismountably attached to the back panel in a manner to permit the covering to be draped over the back support members.

11. An article of furniture of the upholstered type that can be assembled and disassembled, comprising:

two laterally spaced outer side-support panel members;

two inner side-support panel members laterally spaced from and parallel to the two outer side-support panel members;

at least two back panel members linearly attached to each other and each capable of attaching to one outer side-support panel member and one inner side-support panel member, said back panel members being linearly attached to each other by a coupling means comprised of a plurality of coupling bolts attached to the back panel members and at least two horizontally elongated L-shaped brackets having a plurality of channels for receiving the heads of the coupling bolts, said channels extending downward and outward from the center of the L-shaped angle in a manner such that when the heads of the coupling bolts are mated with the channels and pressure is applied downwardly on the brackets the back panel members will be pulled together thereby forming a contiguous back panel;

at least two front panel members linearly attached attached to each other, parallel to the back panel members and each capable of attaching to one of the outer side-support panel members and one of the inner side-support panel members such that the eight panel members, when attached together, form a large inner rectangular compartment and two smaller outer rectangular compartments;

at least two seat members;

means for mounting the two seat members horizontally in the large inner rectangle;

at least two back support members mountable above the seat members and against the back panel members; and two coverings attachable to either the outer side-support panel members or the inner side-support panel members for covering the top opening formed by each of the small rectangles.

12. An article of furniture in accordance with claim 11, wherein the front panel members are linearly attached to each other by a coupling means comprised of a plurality of coupling bolts attached to the front panel members and at least one elongated L-shaped bracket having a plurality of channels for receiving the heads of the coupling bolts, said channels extending downward and outward from the center in a manner such that when the heads of the coupling bolts are mated with the channels and pressure is applied downwardly on the bracket, the front panel members will be pulled together thereby forming a contiguous front panel.

13. An article of furniture of the type that can be assembled and disassembled, comprising:

two laterally spaced outer side-support panel members;

two inner side-support panel members laterally spaced from and parallel to the outer side-support panel members;

at least two back panel members linearly attached to each other by a coupling means comprised of a plurality of coupling bolts attached to the back panel members and at least two horizontally elongated L-shaped brackets having a plurality of channels for receiving the heads of the coupling bolts, said channels extending downward and outward from the center of the L-shaped angle in a manner such that when the heads of the coupling bolts are mated with the channels and pressure is applied downwardly on the brackets the back panel members will be pulled together thereby forming a contiguous back panel and each back panel member capable of attaching to one outer side-support panel member and one inner side-support panel member;

at least two front panel members linearly attached to each other with at least one L-shaped bracket in the same manner as the two back panel members are attached to each other, each front panel member capable of being attached to one of the outer side-support panel members and one of the inner side-support panel members such that the six panel members, when attached together, form a large inner rectangular compartment and two smaller outer rectangular compartments;

at least two seat members;

means for securing the two seat members horizontally in the large inner rectangular compartment;

at least two back support members mountable above the seat members and against the back panel members; and two coverings with a rigid backing on one side of a size sufficiently large to rest on the top of the small rectangular compartment, attachable to either the outer side-support panel members or the inner side-support panel members and drapable over the small rectangular compartment to provide a full-upholstered sofa arm appearance.

14. An article of furniture in accordance with claim 13, wherein the means for mounting the two seat members horizontally in the large inner rectangular compartment further comprises:

at least one side support member for each seat member, the side-support member affixed to the side of the inner side-support panel member, front panel member, or back panel member in such a manner as to support the seat member when the seat member is laid horizontally within the large inner rectangular compartment; and two positioning guides oppositely located on one side of each seat member and parallel to the side-support panel members, wherein one bracket on the back panel member and one bracket on the front panel member are positioned at a desired seat height, each bracket having a slot for mating with the positioning guides.

15. An article of furniture in accordance with claim 13, wherein the back support members include two downwardly projecting, curved hooks and the seat member includes a pair of interior channels parallel to the side-support panel members, each channel having an aperture therein for receiving and retaining a respective hook, the apertures being positioned sufficient distance from the edge most proximate to the back panel member to permit the back support member to lean against the back panel member.

* * * * *